US005660218A

United States Patent [19]

Jonkka

[11] Patent Number: 5,660,218

[45] Date of Patent: Aug. 26, 1997

[54] BLADE SYSTEM TO BE USED IN WOOD CHIPPING, A BLADE; A GUIDE MEMBER AND A FILLER MEMBER AS WELL AS A METHOD FOR CHANGING BLADES

[75] Inventor: Arvo Jonkka, Pori, Finland

[73] Assignee: Sunds Defibrator Woodhandling OY, Pori, Finland

[21] Appl. No.: 564,289

[22] PCT Filed: Jul. 6, 1994

[86] PCT No.: PCT/FI94/00312

§ 371 Date: Dec. 21, 1995

§ 102(e) Date: Dec. 21, 1995

[87] PCT Pub. No.: WO95/01857

PCT Pub. Date: Jan. 19, 1995

[30] Foreign Application Priority Data

Jul. 8, 1993 [FI] Finland ..... 933131

[51] Int. Cl.[6] ..... B27C 7/00; B02C 18/18

[52] U.S. Cl. ..... 144/176; 144/162.1; 144/241; 241/92; 241/294

[58] Field of Search ..... 241/92, 292.1, 241/298, 294, 192; 144/162.1, 176, 218, 241; 407/45, 95, 96

[56] References Cited

U.S. PATENT DOCUMENTS

| | | | |
|---|---|---|---|
| 4,351,487 | 9/1982 | Haller et al. | 241/92 |
| 4,405,092 | 9/1983 | Sybertz et al. | 241/294 |
| 4,423,758 | 1/1984 | Haller et al. | 144/176 |
| 4,503,893 | 3/1985 | Demopoulos | 144/176 |

FOREIGN PATENT DOCUMENTS

| | | |
|---|---|---|
| 384392 | 11/1987 | Austria . |
| 0 033 382 | 8/1981 | European Pat. Off. . |
| 0156934 | 10/1985 | European Pat. Off. . |
| 2938201 | 4/1981 | Germany . |
| 3209246 | 12/1984 | Germany . |
| 453 373 | 2/1988 | Sweden . |

*Primary Examiner*—W. Donald Bray
*Attorney, Agent, or Firm*—Burns, Doane, Swecker & Mathis, L.L.P.

[57] ABSTRACT

The invention relates to a knife system for a machine used in wood chipping, a knife (10), a guide component (14) and a filler part (24) and method of exchanging knives. The system comprises at least one turnable or at least two exchangeable guide components (14), where at least two guiding surfaces are mutually at different distances from the guide component surface supported on the disc.

9 Claims, 6 Drawing Sheets

Figure 3:
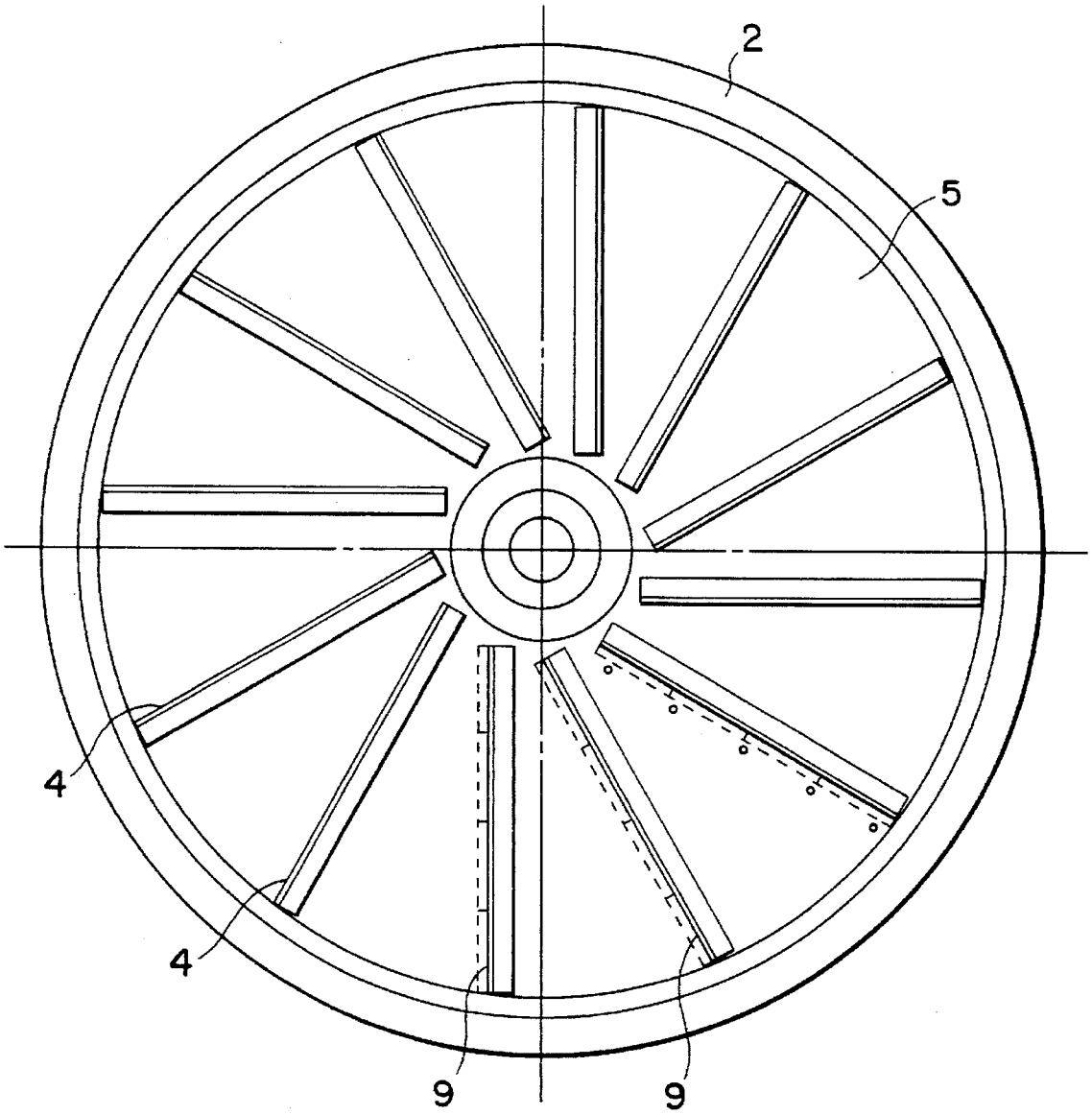

Fig. 1
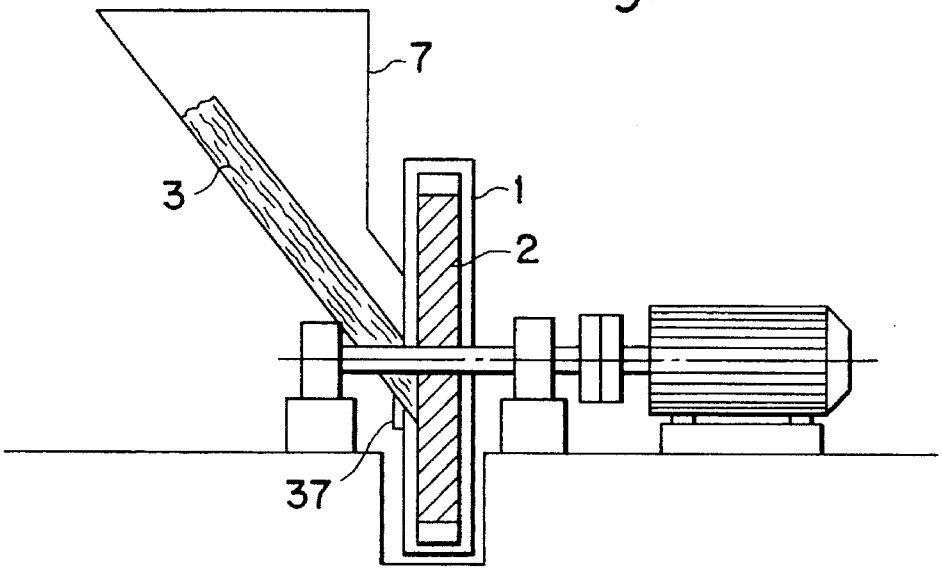
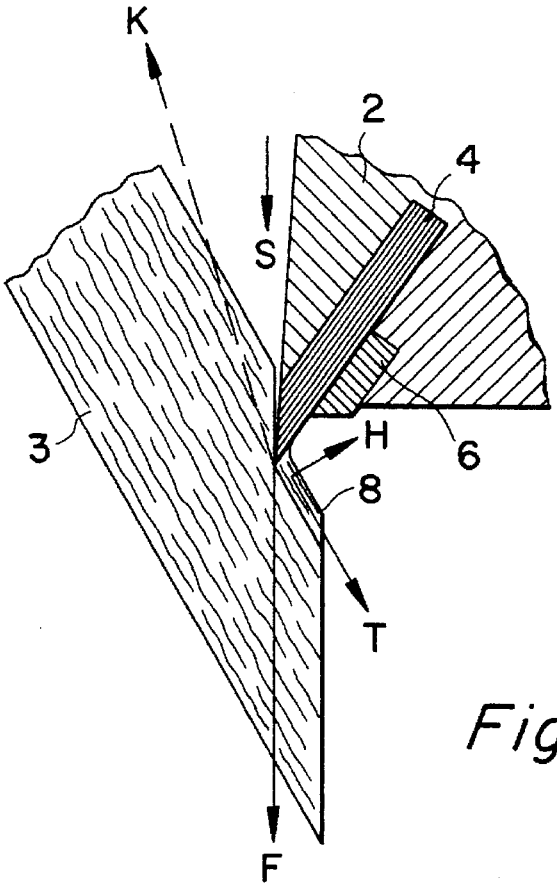
Fig. 2

Fig. 5
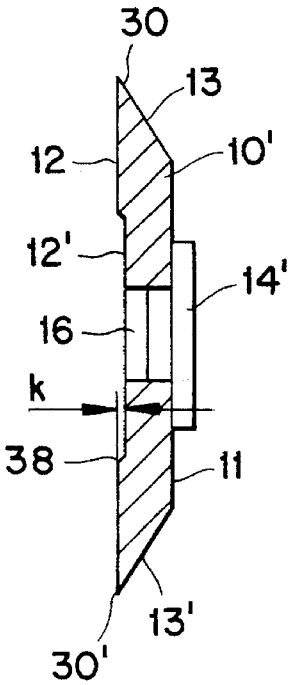
Fig. 7
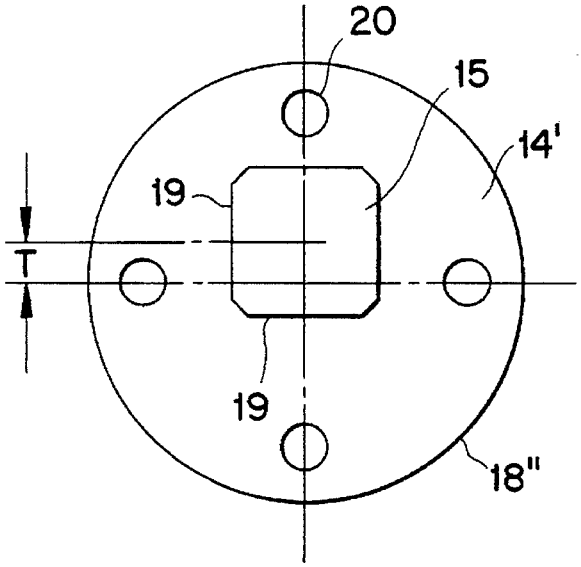
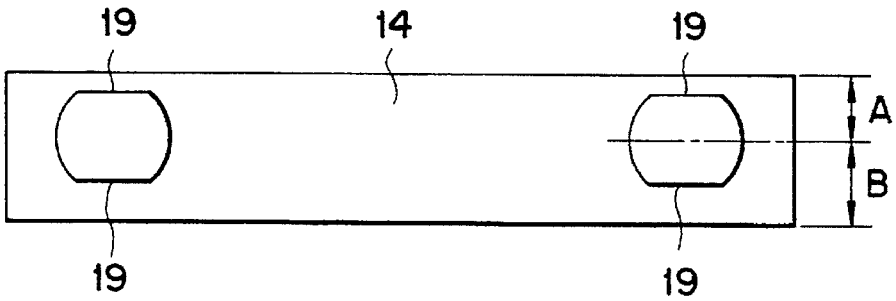
Fig. 6a
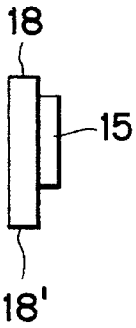
Fig. 6b

BLADE SYSTEM TO BE USED IN WOOD CHIPPING, A BLADE; A GUIDE MEMBER AND A FILLER MEMBER AS WELL AS A METHOD FOR CHANGING BLADES

This invention relates to a knife system, a knife, a guide component and a filler part for a machine used in wood chipping and a method of exchanging knives in accordance with the preambles of claims 1, 2, 3, 4, 7 and 8.

Disc chippers are commonly used in the forest industry for chipping wood before further processing. Knives chipping out chip pieces from a log against fixed counter knife are attached to a rotating disc of the chipper evenly divided and at a certain displacement from the radius. The chipper knife and its mounting form a very important part of the operation of the machine used for chipping pulpwood.

The problem with disc chippers is their knife maintenance which is expensive and time-consuming. Logs of a big diameter require a long cutting length and thus also a long knife. Traditional one-piece knives which must be sharpened by grinding are heavy to handle and they constitute a hazard in terms of labour safety.

The market has nowadays seen an introduction of reversible knife systems formed of section knives. The reversible knives have two cutting edges on their long sides, both of which can be used by reversing the knife. The knife length is only a part of the total cutting length of the disc, and several such section hives are fitted into the disc in a line one after the other. Section hives are exchanged when required, but they are not usually sharpened. When mounting, it is important to place the cutting edges of the section knives exactly on the correct line. Also during operation, the cutting edges must be kept absolutely in the correct position. The main advantage of section knives is that only the poor part of the cutting length may be exchanged. (In this context the cutting length means either the total length of one one-piece knife or the total length of a knife consisting of several section knives.)

One such reversible system is described in SE publication 453 373. The sections are guided along the same line with the aid of the cross-sectional profile of the knife. Disadvantages of the knife according to SE publication 453 373 are high manufacturing costs due to the complexity of the knife and the complexity of the knife mounting system. The knife mounting system which consists of several weak parts will usually break when a stone or a steel object gets into the chipper.

A reversible knife system is also described in US patent publications U.S. Pat. Nos. 4,423,758 and 4,503,893. According to these publications, a knife block as long as the total cutting le is used for guiding the short section knives. The knife block has longitudinal ridges fitting into corresponding longitudinal grooves in the knives and thus they guide the section knives along the correct line. US patent publication U.S. Pat No. 4,351,487 again describes an arrangement wherein the section knives are guided directly in line by a rod of a circular cross-section and of a length equal to the total cutting length and fitting into a longitudinal groove in the knife and in the knife holder. Alternatively, a protrusion which is one piece with the knife holder may be used instead of a separate guiding rod. The knives according to these inventions suffer from the disadvantage that the deep groove in the knife adds to the manufacturing costs and weakens the strength of the knife. The protrusion of the same size as the knife also gives rise to much increased costs of manufacture.

The object of the present invention is to bring about an exchangeable knife allowing minimized knife maintenance costs. The characteristic features of the invention are stated in claims 1, 2, 3, 4, 7 and 8.

According to the invention, the cutting length of a disc chipper knife is divided preferably into two or three pieces. Guiding of knife pieces On the same line and keeping in place of the pieces is ensured by a guide, the position of which is changed after sharpening. In a disc chipper, chipping and thus also knife wear are greatest in the central part of the disc. Use of the knives can hereby be continued by changing the position of section knives so that the worn parts are located on the outer periphery and close to the chipper axis, whereby the sharp section will be located at the chipping point.

A knife system according to the invention guides the knife or knives longitudinally of the cutting length and the movable knife consists of an exchangeable wearing knife part and a guiding component which does not wear during chipping. These can be placed together without tools with the aid of suitable guiding recesses and pins and they ensure that the cutting edge of the knife will be located in the correct place when knives are exchanged and they prevent the knives from moving during chipping.

The cutting length in wood chipping is made up of two or several section knives. The guiding section is guided along a recess in the knife disc. By turning or exchanging the guiding section, the cutting edge of the wearing section can be placed in its proper position after sharpening. The knife position can be changed by using guide components, wherein guide pins are located eccentrically in relation to the edges of the guide component. When the guide components are turned, the position of the cutting edge of the knife will change. In addition, two mutually different guide component sets, for example, may be used, in which the guide pins are located differently in relation to the guide edges. In this way, many different knife positions are obtained by exchanging and turning the guide components. It is recommended in practice always to exchange or turn around a guide component set for the whole knife disc.

The guiding recesses in the wearing and exchangeable section knife are usually holes, which may be easily made so that the section to be renewed is advantageous as regards knife maintenance. For hard wood, for example, birch or tropical wood types, such a guiding groove must be made which prevents sticks from entering between the knives and the mounting means.

The section knife can be resharpened, because the position of its cutting edge can be kept unchanged by turning or exchanging the eccentric guide component.

Figure 4A:
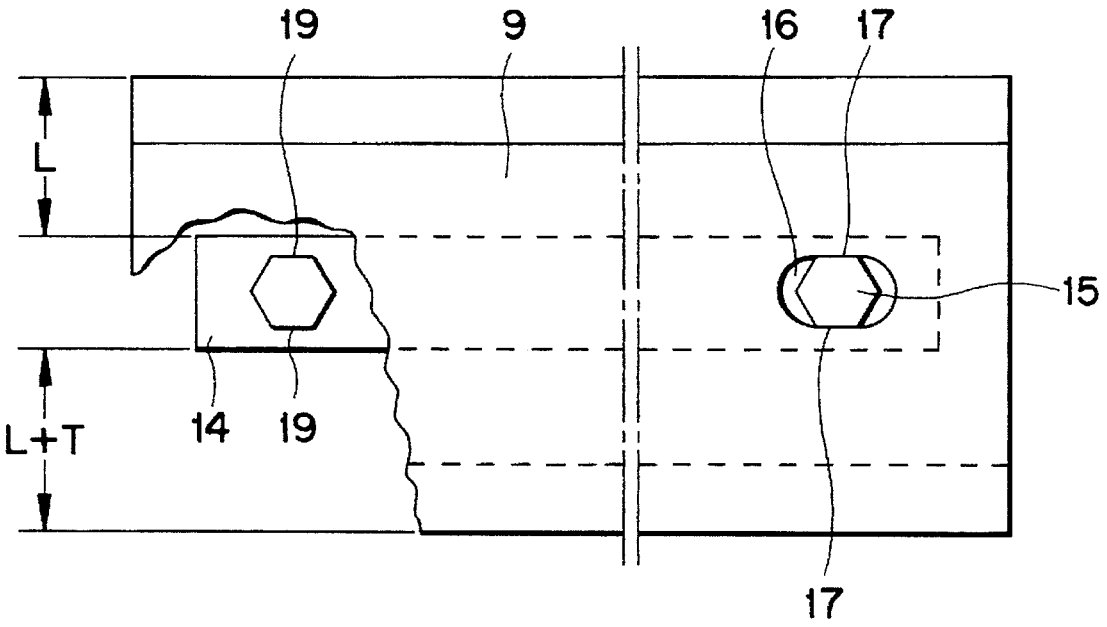
Figure 4B:
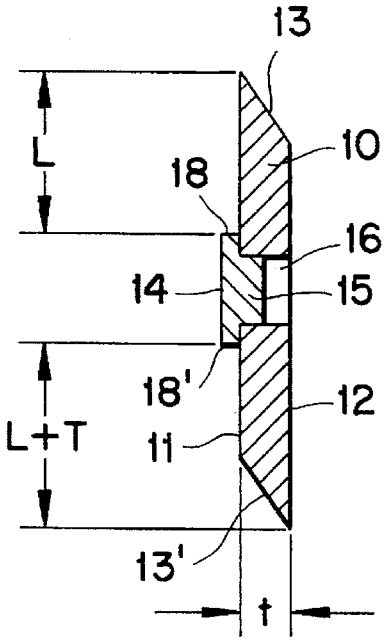
Figure 8:
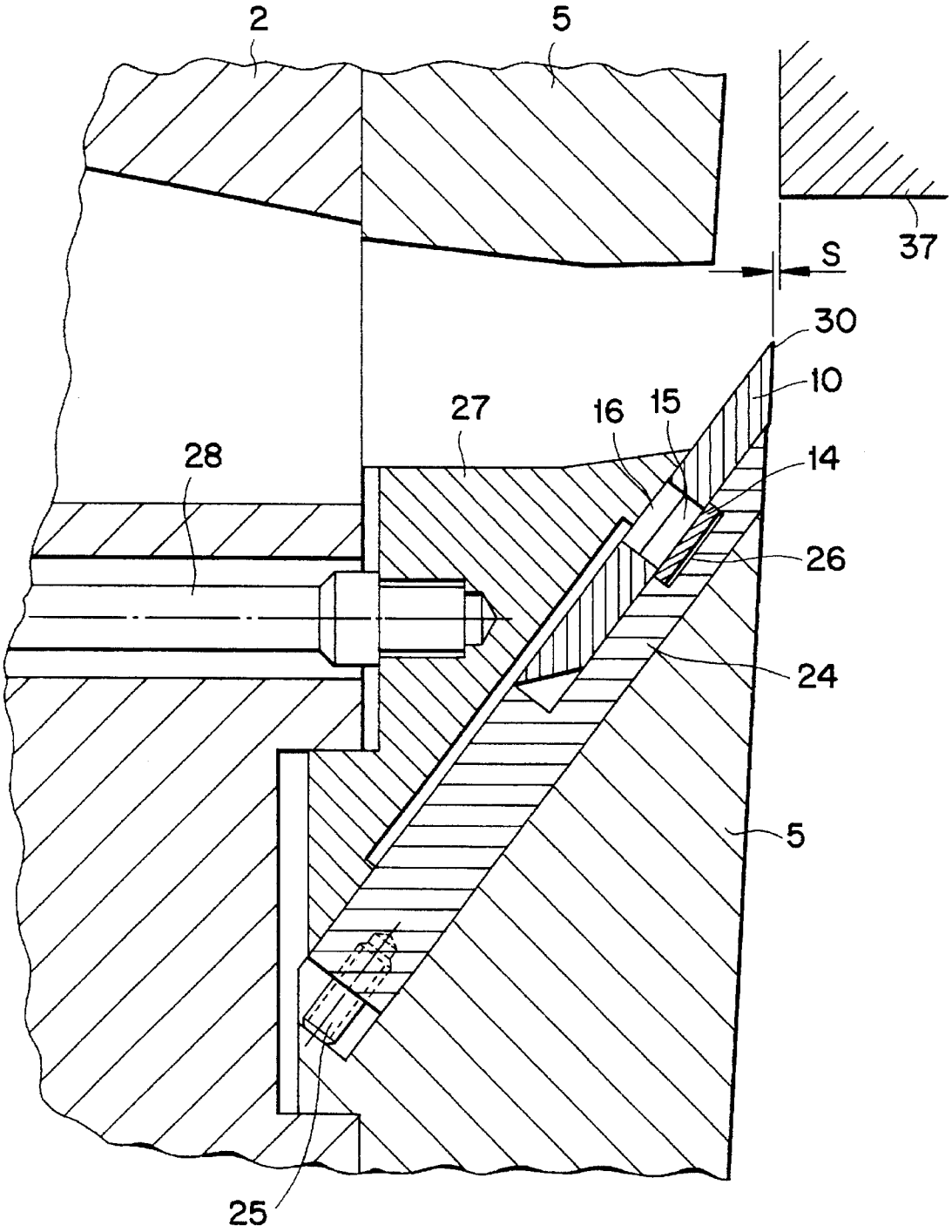

The invention and its details are desribed in detail in the following, referring to the enclosed drawings, wherein FIG. 1 is a side view of a conventional disc chipper, FIG. 2 shows the wood chipping process, FIG. 3 shows a knife disc seen along the shaft, from the knife cutting side or from the log feeding side, FIGS. 4*a* and 4*b* show an application of the knife and guide component in a knife system according to the invention, from the knife side and as a cross-section, FIG. 5 is a cross-sectional view of another alternative, FIGS. 6*a* and 6*b* are side and end views respectively of the guide component, FIG. 7 is a side view of a guiding component which can be turned around in its place, FIG. 8 is a sectional view, in a plane parallel to the shaft of the disc, of a knife system according to the invention applied to a conventional disc chipper in the knife exchange position, and FIG. 9 likewise shows a knife system according to the invention applied to an arrangement where the knives are exchanged from one side of the disc.

FIG. 1 shows a generally known disc chipper 1, where a knife disc 2 uses conventional knives 4 in accordance with FIG. 2 or section knives in accordance with the invention which are located as shown in FIG. 3. Logs 3 to be chipped are fed into the chipper at a certain angle by means of a chute 7.

FIG. 2 shows the chipping process, wherein the knife disc 2 moving in direction S and the knife 4 which goes with it are cutting the log 3 with a force F parallel to the arrow and are working chip pieces 8 loose with forces H (cleaving) and T (pushing), whose combined counter force K is applied to the knife 4. The flow of chip pieces worked loose from the log hits a knife block 6, which is usually made of high-class steel and is a slowly wearing and exchangeable part.

In chipping coniferous trees, the force K in FIG. 2 is 30–30 N/mm. In practice, the knife 4 must be able to with-stand-forces in excess of 100 N/mm. Given a friction coefficient μ of 0.2 with friction on both sides, a compression force of 250 N/mm is required giving a total compression force of 200 kN with a knife 800 mm long.

Any displacement of the knives during chipping must be totally prevented, because knife damage will follow immediately should they hit, for example, a counter knife 37 (FIG. 1). The compression force stated above is already very high as such and it is difficult in practice to increase it to ensure mounting. The problem becomes even worse when the knife cutting length is distributed between several section knives, whereby the total chipping force may be applied to only one section knife. Conventional long knives distribute the chipping force over the entire knife length.

FIGS. 4*a* and 4*b* show a knife 9 in accordance with the invention which consists of sections 10. Section knives 10 can be sharpened and reversed. A section knife 10 is made of a plate of a thickness t. The knife 10 has two mutually parallel surfaces 11 and 12 as well as cutting surfaces 13 and 13'. The knife 10 has two holes 16 close to its ends. The holes are elongated so that their greatest length and the planar hole wall surfaces 17 are in the lengthwise direction of the knife. The distance of the hole from both longitudinal edges of the knife is of equal length.

The section knife 10 is guided into its position by a guide 14. In the embodiments shown in FIGS. 4–6, the guide is an elongated strip almost as long as the section knife 10 and having two protruding guide pins 15. A guide in accordance with FIG. 7 which can be turned around in its place and which has one guide pin 15 may also be used. In a sliding fit, the guide pin diameter transversely of the strip is equal to the distance between the planar surfaces 17 in the knife holes 16 and their distance from both longitudinal edges of the strip part 14 is of equal length. The guide pins are located in the knife holes. Guiding of the knife into its proper position transversely of the knife takes place with the aid of the pins of the guide 14 and with edge surfaces 18, 18' and 18" of the guide. The elongated straight-sided holes 16 allow a prompt fitting together of the section knife 10 and the guide 14 and they allow the knife to move in relation to the guide in the lengthwise direction of the knife.

FIG. 4*b* shows an asymmetrical guide 14 which is turned around to obtain two different distances from the cutting edge of the knife 10. Distance L+T is with an unsharpened knife and distance L with a sharpened knife, whereby T is the sharpening distance.

FIG. 5 shows another structural application of a knife 9', whereby the cutting edges 30 and 30' of a section knife 10' are on the same side of the knife, that is, they meet the plate surface 12. Besides guide holes, the knife 10' according to FIG. 5 has a recess part 12' made in the plate surface and providing surfaces 12 and 12' with a level difference k. Given the structure shown in the figure, the surface 12 working chips loose from the log is at a higher level than the mounting surface 12' and thus the risk of penetration by dust and sticks is considerably less than with one level surface 12 as shown in FIG. 4*b*. The knife in accordance with FIG. 5 makes this structure possible, because both cutting edges 30, 30' are on the surface 12, the setup of which in relation to surface 12' results in a step 38 which guides the chips better onto the next surface.

FIG. 6 shows an asymmetrical guide 14 with pin components 15 located eccentrically in relation to the strip component so that the distance B of the pin from one edge of the strip is longer than the distance A from the other edge of the strip. B-A is the displacement distance of the cutting edge 30 transversely of the knife when the eccentric guide 14 is turned around. The pin component is made with planar surfaces 19 so that sufficient contact surfaces are obtained with knife holes 16.

FIG. 7 shows an alternative guide 14' with a pin component 15 located eccentrically in relation to a circular platelike component which can be turned in its place around its central axis, so that the two opposite sides of the pin made with a square cross-section have a mutual eccentricity from a guiding edge 18" equal to the knife sharpening distance T, whereas the other opposite pin sides are located with the same distance from the guiding edge. The pin component is made with planar surfaces 19 so that sufficient contact surfaces are obtained with knife holes 16. It is advantageous in practice to lock guides 14' into their positions with the aid of mounting holes 20.

The guide in accordance with FIG. 7 allows three different positions for the cutting edge of the knife 10. The guide pin component in accordance with FIG. 7 can also be made with a hexagonal cross-section, whereby five different knife positions are obtained, but the guiding surface 19 will then be considerably shorter.

FIG. 8 shows how the invention is used in a conventional disc chipper. The knife disc 2 is provided with wear plates mounted to the disc with screws (not shown in the figure). In the place of the conventional one-component knife 4 in accordance with FIG. 2, there is positioned a filler part 24, besides the knife 10 in accordance with FIG. 4*b* or the knife 10' in accordance with FIG. 5. The length of the filler part is equal to the total cutting length and it has a guiding groove 26 extending over its entire length or in a longitudinal line two or several separate guiding recesses for guides 14' which can be turned around in their places.

One edge of the filler part 24 has control screws 25 to control the distance of the filler part from the bottom of the knife groove in the wear plate 5 by turning the screws in or out in relation to the edge of the filler part.

The pins 15 of the guides 14 or 14' are fitted into the holes 16 in the knives 10. The parts 10, 14 and 24 are pressed into their positions with the aid of a knife holder 27 and tightening screws 28. The guide 14 guarantees that all knives 10 will be positioned properly in line and knife clearance S to the counter knife 37 will be constant. When the reversed knives 10 have lost their sharpness they can be resharpened and the same position is obtained for the cutting edge of the knife 10 by turning or exchanging the guide 14 or by turning the guide 14' in accordance with FIG. 7. This method may also be used when the length of knives 10, 10' is equal to the total cutting length and shorter section knives are not used.

In practical work, maintenance of knives must be done approximately every 8 hours, whereby new knives 10 and 10' are mounted on the main chipping line. On other chipping lines knives are replaced when required. Knives 10 or 10' which are mounted on the disc must always have their cutting edge 30 located in the same position. When hives of the same dimensioning have been used, for example, for 2–6 months, guides 14 are exchanged or turned around and "undersized" knives are then used with their cutting edge 30 located in the proper position with the aid of guides 14 or 14'.

In ordinary use the distance of the cutting edge from the opposite edge of the knife becomes shorter in every sharpening by 1 mm, that is, T=1 mm, and the knives may be sharpened three times. Hereby two different asymmetrical guides 14 or a turnable guide 14' will be required to guide the knife into 3–5 different positions in all. Both guides 14 are of the same width so that the guide fits into the guiding groove. Likewise, the guide pins in both sides have the same diameter, but the asymmetry of the guide pins is different in each guide. If only one asymmetric guide 14 is used, only one position is obtained for the knife 10 or 10' and only one resharpening will be possible.

Figure 9:
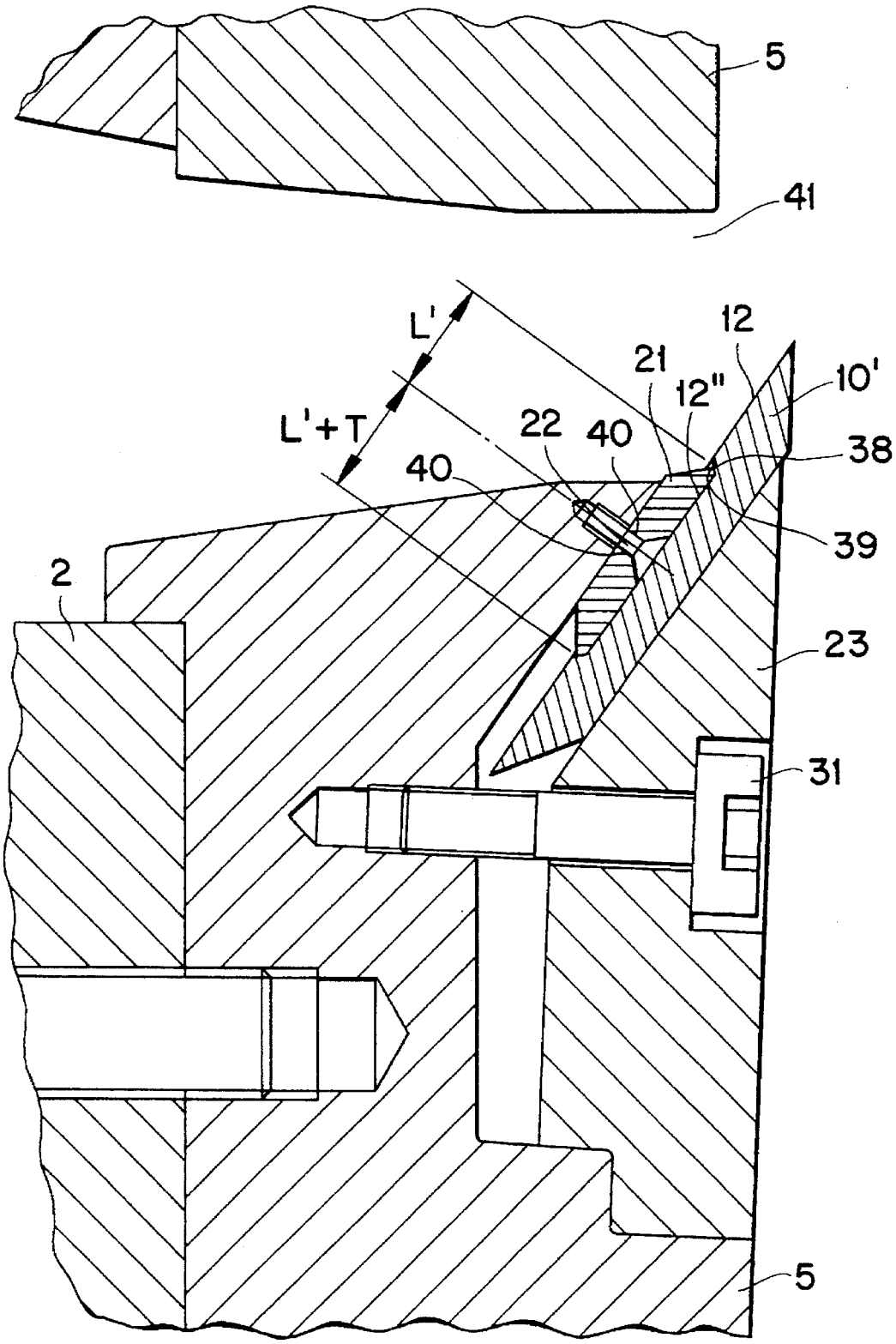

FIG. 9 shows an application of the invention wherein the guide function is combined with a knife block 6 according to FIG. 2 which is used at the present time. Instead of a guide 14, a knife block 21 according to FIG. 9 is used which is mounted with screws 22 and the length of which is equal to the total cutting length or the total length of section knives 10'.

The knife according to FIG. 9 has a mounting surface 12" at a much deeper level than the surface 12. The recess k and the side surfaces 38 are considerable so that the surfaces 38 also form guiding surfaces, whereby no guiding holes are needed. The costs of manufacturing the knife hereby increase, because a stronger plate raw material is required, but the knife function also on very hard wood compensates for the said increased cost.

By means of screws 31, the knife holder 23 is pressed against the knife 10', which is pressed towards the guiding knife block 21 and against the wear plate 5. The correct position of the knife 10 is determined by guiding surfaces 39 on the guiding knife block 21 which will be positioned against the surfaces 38 of the knife 10'. The knife block guide hereby ensures that all knives 10 will be placed along the same line and will remain there when the knives are moved in their lengthwise direction and are pressed into position with the aid of knife holder 23.

The walls of the holes for screws 22 in the knife block 21 are marked with a reference number 40 and the walls function as guiding surfaces between the knife block and the disc. The holes are located asymmetrically in the knife block so that their distance L' from one longitudinal edge of the knife block is shorter than the distance L'+T from the other edge. When a sharpening distance T has been sharpened off the knife, its cutting edge is placed in its correct position by turning the knife block 21 the other way around.

The knives in a chipper according to FIG. 9 are exchangeable from one side of the disc by means of screws 31 extending through the knife holder component 23. The system according to FIG. 9 also guarantees that sticks resulting from the chipping will not enter between the knife block 21 and the knife 10, because the knife surface 12 protrudes from the joint between the knife block 21 and the knife towards a chip opening 41, thus protecting the joint from the chip flow.

The guide 14 or the guiding knife block 21 can be suitably magnetized so that it will remain more easily in its position and it is prevented from falling down. The magnetized guide adheres to the knife or to the edges of the guiding groove, but it can still be easily moved. When using a structure in accordance with FIG. 9, it is especially advantageous when exchanging knives that the knife adheres to the guide 21.

The invention is not restricted to the applications presented above, but it may vary in different ways within the scope of the claims.

There may be more holes 16 than two in the knives and similarly there may be more guiding pins in the guide 14.

The positions of the guide pins 15 and the holes 16 may also be the other way round, so that the guide pins are in the knife 10, 10' and the holes are in the guide 14 or 14'. However, this will increase the costs of manufacturing the knives yes, so the application shown in the drawings is the more advantageous alternative.

The reversible knife/guide system according to the invention which can be sharpened can also be applied when using long knives of a length equal to the total cutting length. Even a long knife 10, 10' is then considerably lighter than the present knife 4. The knives can then also be easily sharpened and used 2–5 times with the aid of a guide 14, 14' or 21.

In this connection, guide pins mean any protrusions with a dimension transversely to the knife equal to the distance between the lengthwise guiding surfaces 17 of the holes 16.

The lengthwise guiding surfaces of the knife need not necessarily be planar surfaces, but their cross-section transversely to the knife can also be curved. This is true both for the guiding surfaces between the knife 10, 10' and the guide component 14, 14', 21 and for the guiding surfaces between the guide component 14, 14', 21 and the guiding groove 26. However, from the viewpoint of manufacture, planar surfaces and such ones in particular which are perpendicular to the knife plane are more advantageous.

The invention may be applied not only to a disc chipper but also to other machines used in wood chipping.

I claim:

1. A knife system for a disc chipper, the system consisting of several knives in the disc and a counter knife, whereby each disc knife is formed by at least two reversible section knives which can be resharpened and are mounted in a line one after the other, and wherein the cutting edges of the section knives are guided transversely into a certain position by means of guiding surfaces in removable guide components supported on the disc and fitted against the edges of guiding recesses in the side surfaces of the section knives, the said recess edges being parallel to the longitudinal direction of the knife, characterized in that the system comprises at least one turnable or at least two exchangeable guide components, in which at least two guiding surfaces to be fitted against the said edges of the guiding recess in the side surface of the section knife are mutually at different distances from the guiding surface between the guide component and the disc.

2. A knife system according to claim 1, characterized in that the guiding recesses in the section knives consist of at least two elongated guide holes one after the other on the center line of each section knife, and that each guide component has at least one guide pin to be fitted in these holes and having a diameter in the transverse direction of the knife in a sliding fit equal to the distance between the longer walls of the elongated guide hole, these walls being parallel to the longitudinal direction of the knife.

3. A knife system according to claim 1, where the guiding recess in the section knife consists of a groove parallel to the longitudinal direction of the knife and extending to the whole length of the knife, characterized in that the bottom of the groove is a planar surface against which the guide component can be fitted, and that the guide component has fastening holes located so that their distance from one longitudinal edge of the guide component is greater than the distance from the other longitudinal edge.

4. A reversible section knife which can be resharpened, for a disc chipper, provided with several knives and a counter knife, the length of which section knife is part of the cutting length of each knife on the chipper disc, whereby for each cutting length at least two section knives in a line one after the other can be fitted on the disc and guided transversely along a certain line by means of removable guide components supported on the disc, where the section knife has several guiding recesses comprising walls parallel to the longitudinal direction of the knife, into which recesses guiding protrusions in the guide component can be fitted, characterized in that the guiding recesses in the section knife consist of at least two elongated guiding holes one after the other on the center line of the knife.

5. A guide component for guiding the reversible section knifes along a certain line in a disc chipper which section knives can be resharpened and fitted in a line one after the other, which guide component has guiding surfaces which can be fitted against the edges of a guiding recess in the side surface of the section knife, the said edges being parallel to the longitudinal direction of the knife, and which guiding surfaces guide the section knife in its transverse direction into a certain position and which guide component can be fitted in at least two different positions in relation to the knife, characterized in that at least two of said guiding surfaces of the guide component which can be fitted against the edges of the guiding recess in the side surface of the section knife are mutually at different distances from the guide component surface which is supported on the disc.

6. A guide component according to claim 5, characterized in that it can be turned in relation to the knife plane around a perpendicular axis.

7. A guide component according to claim 6, characterized in that it has at least one guide pin (15) to be fitted into an elongated guide hole (16) in the section knife (10), the diameter of the pin being in the transverse direction of the knife in a sliding fit equal to the distance between the longitudinal walls (17) of the elongated guide hole, these walls being parallel to the longitudinal direction of the knife.

8. A guide component according to claim 5, characterized in that it has at least one guide pin to be fitted into an elongated guide hole in the section knife, the diameter of the pin being in the transverse direction of the knife in a sliding fit equal to the distance between the longitudinal walls of the elongated guide hole, these walls being parallel to the longitudinal direction of the knife.

9. A method of mounting and exchanging reversible section knives of a disc chipper used in wood chipping and provided with several knives and a counter knife, which section knives are fitted in a line one after the other and can be resharpened and guided transversely along a certain line by means of removable guide components supported on the disc, whereby the distance of the cutting edge of the section knives from the opposite knife edge, which distance has been shortened as the section knives were sharpened, is compensated for and the position of the cutting edge is maintained by using a removable guide component so that the distance of the cutting edge of the knife from the guide component surface supported on the disc remains unchanged, comprising the steps of:

turning the guide component so that the guide surfaces of the guide component which are to be fitted against the edges of a guiding recess in the side surface of the section knife and, positioning the edges being parallel to the longitudinal direction of the knife at different distances from the guiding surface between the guide component and the disc.

* * * * *